US008702375B1

(12) United States Patent
Liang

(10) Patent No.: US 8,702,375 B1
(45) Date of Patent: Apr. 22, 2014

(54) TURBINE STATOR VANE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 441 days.

(21) Appl. No.: 13/111,113

(22) Filed: May 19, 2011

(51) Int. Cl.
*F01D 9/02* (2006.01)
*F01D 25/08* (2006.01)

(52) U.S. Cl.
USPC ..... 415/115; 415/116

(58) Field of Classification Search
CPC ..... F01D 5/18; F01D 5/186; F01D 25/12; F01D 25/08; F01D 9/02; F01D 9/06
USPC ..... 415/115, 116; 416/96 R, 97 R, 97 A
See application file for complete search history.

(56) References Cited

U.S. PATENT DOCUMENTS 3,369,792 A * 2/1968 Kraimer et al. ..... 415/115
5,217,348 A * 6/1993 Rup et al. ..... 415/115
5,358,374 A * 10/1994 Correia et al. ..... 415/47
5,488,825 A * 2/1996 Davis et al. ..... 60/806
5,511,309 A * 4/1996 Beabout ..... 29/889.72
5,609,466 A * 3/1997 North et al. ..... 415/115
6,077,034 A * 6/2000 Tomita et al. ..... 415/110
6,099,244 A * 8/2000 Tomita et al. ..... 415/115
6,217,279 B1 * 4/2001 Ai et al. ..... 415/110
6,398,488 B1 * 6/2002 Solda et al. ..... 415/115
6,884,023 B2 * 4/2005 Dube et al. ..... 415/116
6,929,445 B2 * 8/2005 Zatorski et al. ..... 415/115
6,955,523 B2 * 10/2005 McClelland ..... 415/115
7,150,601 B2 * 12/2006 Pietraszkiewicz et al. . 416/97 R
7,600,973 B2 * 10/2009 Tibbott et al. ..... 416/97 R
2009/0068023 A1 * 3/2009 Liang ..... 416/97 R
2009/0304520 A1 * 12/2009 Brittingham et al. ..... 416/97 R

* cited by examiner

*Primary Examiner* — Nathaniel Wiehe
*Assistant Examiner* — Wayne A Lambert
(74) *Attorney, Agent, or Firm* — John Ryznic

(57) ABSTRACT

A stator vane for an industrial turbine, the vane includes a serpentine flow cooling circuit for cooling of the airfoil, and two separate purge air channels to supply air to the rim cavities. The purge channels are formed as separate channels from the serpentine flow channels so that the purge air is not heated by the hot metal and has smooth surfaces so that pressure losses is minimal.

10 Claims, 8 Drawing Sheets

TURBINE STATOR VANE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a stator vane in an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

In the turbine section, cooling air used for the inter-stage housing is supplied through the stator vane. FIGS. 5 and 6 show two of the prior art methods of providing cooling air through the vane to the inter-stage housing located inside of the inner endwall or shroud of the stator vanes. In FIG. 5, cooling air from the first leg of a serpentine flow cooling circuit formed within the vane is bled off at an end of the first leg and passed through a hole formed within a cover plate. The hole in the cover plate can be sized to regulate the amount and pressure of the cooling air bled of from the first leg. In the FIG. 5 design, the root turn is located within the hot flow path through the vanes. In FIG. 6, the bleed off hole is located within a root turn of the serpentine circuit. In both of the FIG. 5 and FIG. 6 purge air circuits, the cooling air for the front rim cavity is used for the cooling of the airfoil leading edge region. Because of this, the purge air for the inter-stage housing is over-heated and root turn passage increases turbulence within the cooling air and thus induces uncertainties for the root turn losses. Because of the over-heated purge air for the inter-stage housing, the turbine section overheats resulting in a shorter engine life.

BRIEF SUMMARY OF THE INVENTION

A turbine stator vane with separate cooling air channels to supply cooling air to an inter-stage housing of the turbine. A separate serpentine flow cooling circuit is used for cooling of the airfoil of the stator vane so that the cooling air used for the inter-stage housing is not heated from the airfoil leading edge region. The cooling channel used for the inter-stage housing is located between adjacent legs or channels of the serpentine flow circuit and extends from the outer shroud to the inner shroud.

DETAILED DESCRIPTION OF THE INVENTION

Figure 1:
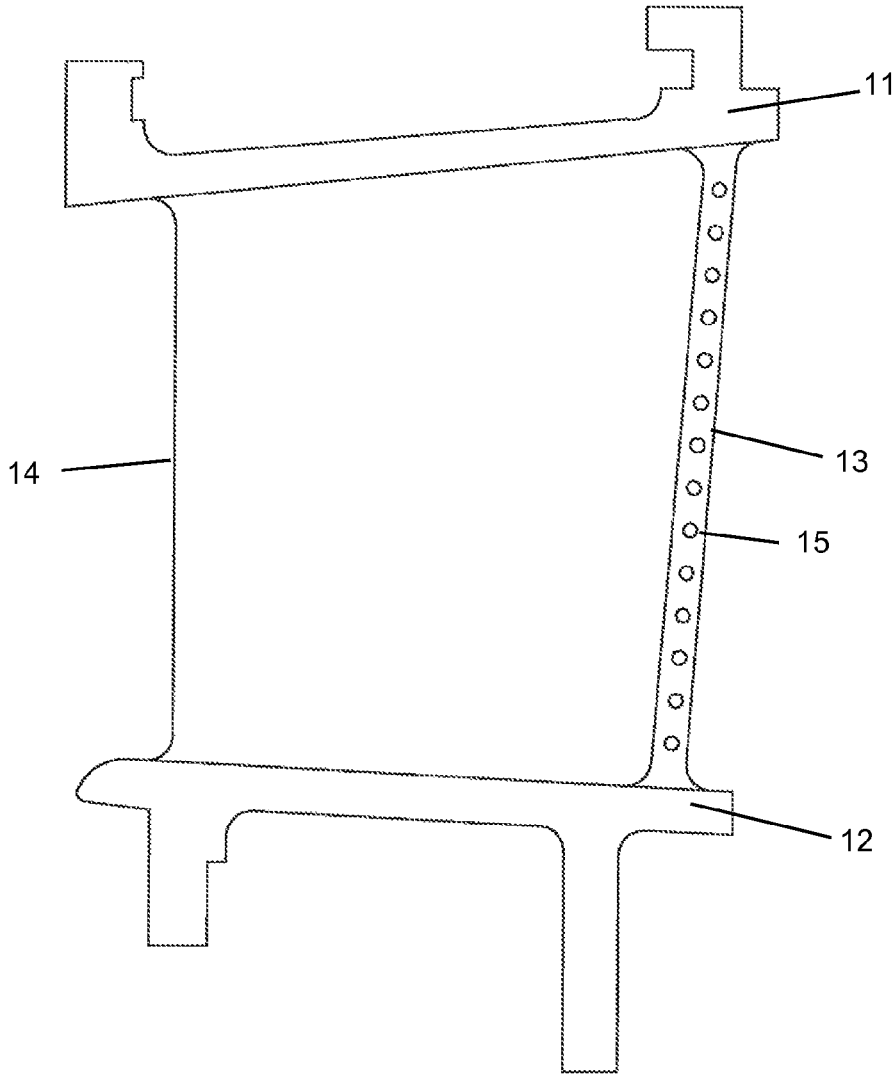
FIG. 1 shows a side view of a turbine stator vane of the present invention.
Figure 2:
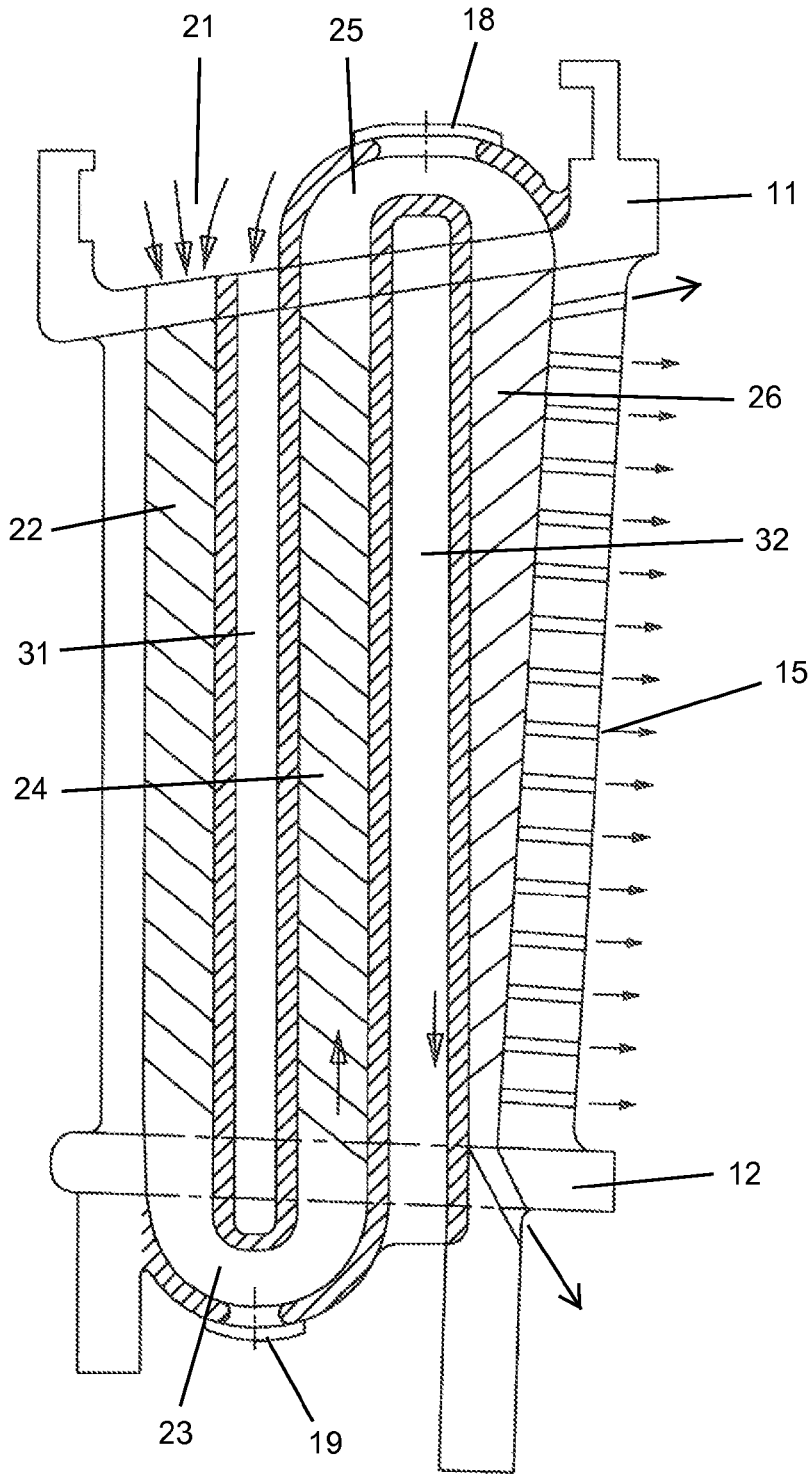
FIG. 2 shows a cross section view through the side of the vane of the present invention with the cooling circuits.

A turbine stator vane with the cooling circuit of the present invention is shown in FIGS. 1 and 2. The cooling circuit of the present invention is intended for use in an industrial gas turbine engine because of the long life requirement for the turbine section, especially for a vane cooling circuit that uses purge air for airfoil cooling such as vanes in the second and third stages of the turbine. FIG. 2 shows the vane with an outer endwall 11 and an inner endwall 12, a serpentine flow cooling circuit to cool the airfoil section, and two separate purge air cooling channels 31 and 32 located between legs of the serpentine flow circuit. The serpentine flow circuit includes a first leg or channel 22 located along the leading edge of the airfoil, a lower turn channel 23 that opens into a second leg 24 of the serpentine flow circuit, an upper turn 25 that leads into a third leg 26 of the serpentine flow circuit, and a row of exit cooling holes 15 along the trailing edge for the airfoil. Cover plates 18 and 19 are used on the turn channels to close off print-outs that are used in casting the vane. FIG. 1 shows the vane with a leading edge 14 and a trailing edge 13.

Figure 8:
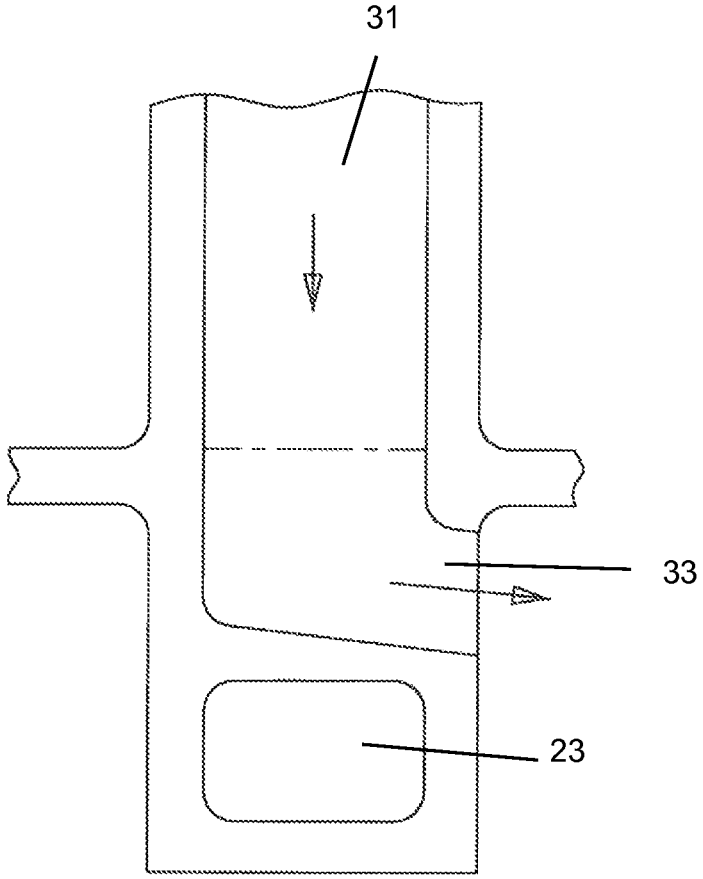
FIG. 8 shows a cross section view of the bottom section of the first thru channel in the vane of the present invention.
Figure 9:
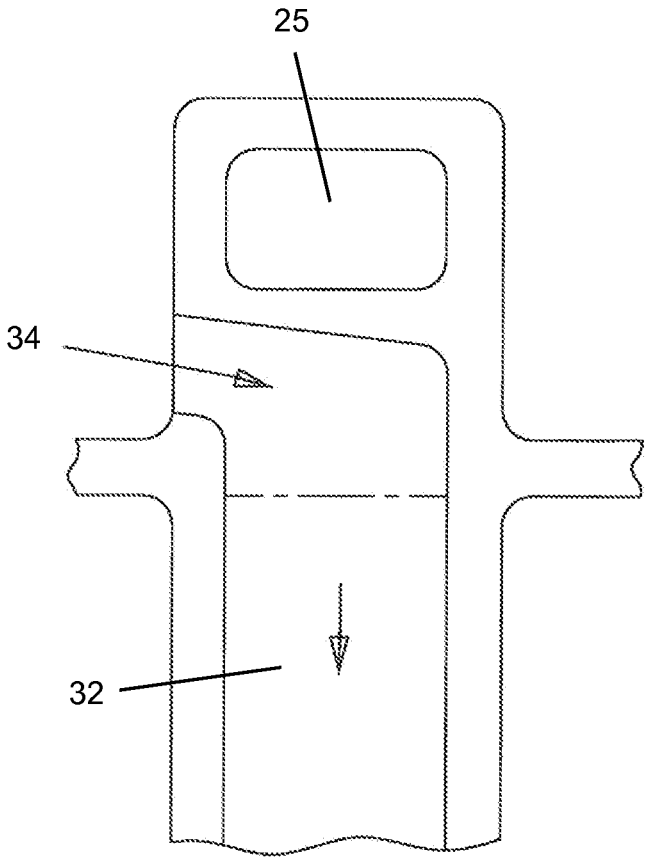
FIG. 9 shows a cross section view of the top section of the second thru channel in the vane of the present invention.

Two separate purge air cooling channels are formed within the airfoil between legs of the serpentine flow circuit to supply fresh cooling air to the inter-stage housing located below the inner shroud. The first purge air cooling channel 31 is located between the first and second legs 22 and 24 of the serpentine flow circuit and has an inlet that opens into the impingement cavity 21 above the outer shroud 11. A second purge air cooling channel 32 is located between the second and third legs 24 and 26 of the serpentine flow circuit and has an inlet that opens into the impingement cavity 21 but opens on the side of the airfoil just below the upper turn channel 25 as seen in FIG. 9. The first purge channel 31 discharges at a lower end onto the side of the airfoil as seen in FIG. 8 just above the lower turn channel 23.

Figure 3:
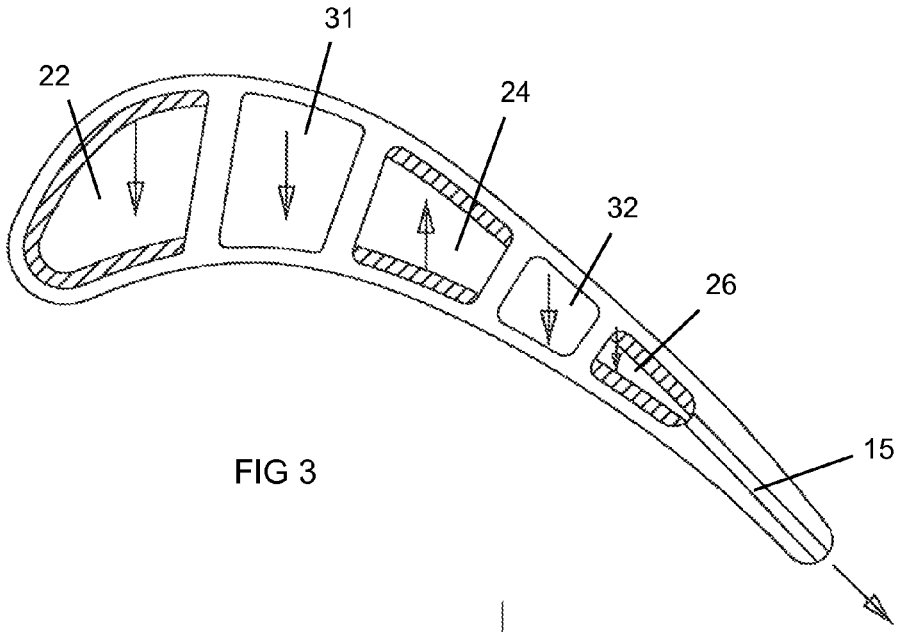
FIG. 3 shows a cross section view through the top of the vane of the present invention with the cooling circuits.
Figure 4:
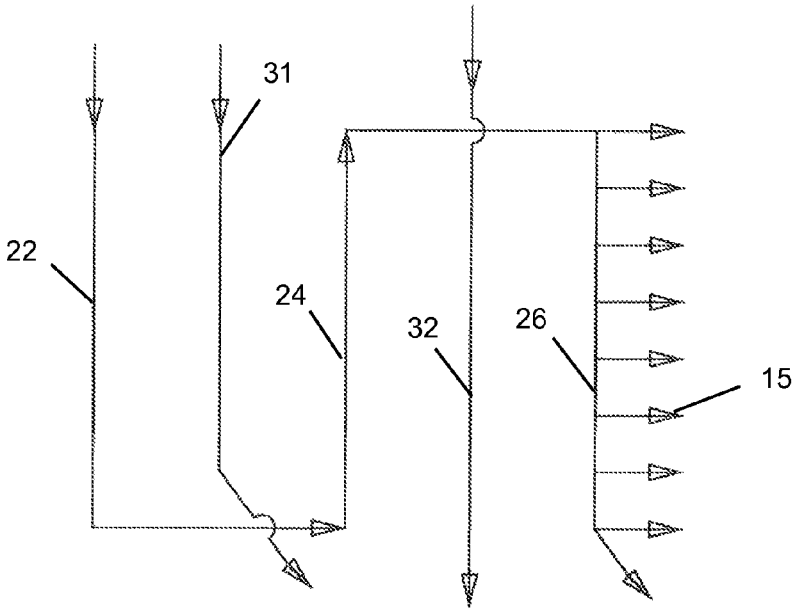
FIG. 4 shows a diagram view from the side of the vane cooling circuits of the present invention.

FIG. 3 shows a cross section view of the vane cooling circuit with the serpentine flow cooling circuit having the three legs 22, 24 and 26 with the first and second purge channels 31 and 32 located between adjacent legs. FIG. 4 shows a flow diagram for the cooling circuit with the purge channels 31 and 32 supplied with cooling air from the impingement cavity just as the serpentine flow circuit is. However, because the two purge channels 31 and 32 are supplied with fresh cooling air that does not pass through the first leg of the serpentine flow circuit, the cooling air is not heated from the leading edge region. Both purge channels 31 and 32 discharge the purge air into the inter-stage housing located below the inner shroud 12 of the vane. The first purge channel 31 includes an outlet 33 to discharge the purge air into the rim cavity. The second purge channel 32 includes an inlet 34 so supply the channel with purge air. As seen in FIGS. 8 and 9, the inlet 34 and the outlet 33 are both located on the side of the airfoil.

Figure 5:
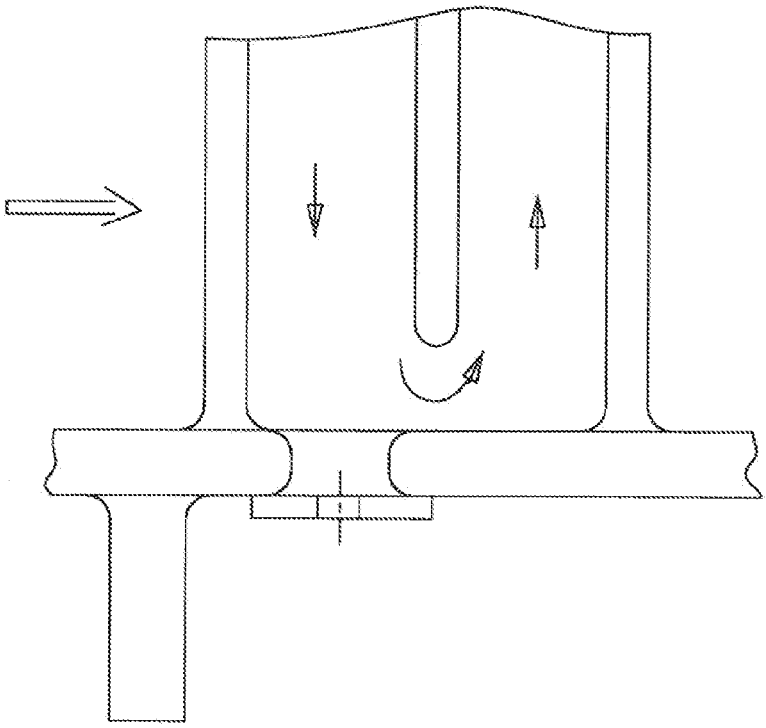
FIG 5 Prior Art
FIG. 5 shows a close-up view of a cross section for a prior art vane cooling circuit used to supply purge air to an inter-stage housing.
Figure 6:
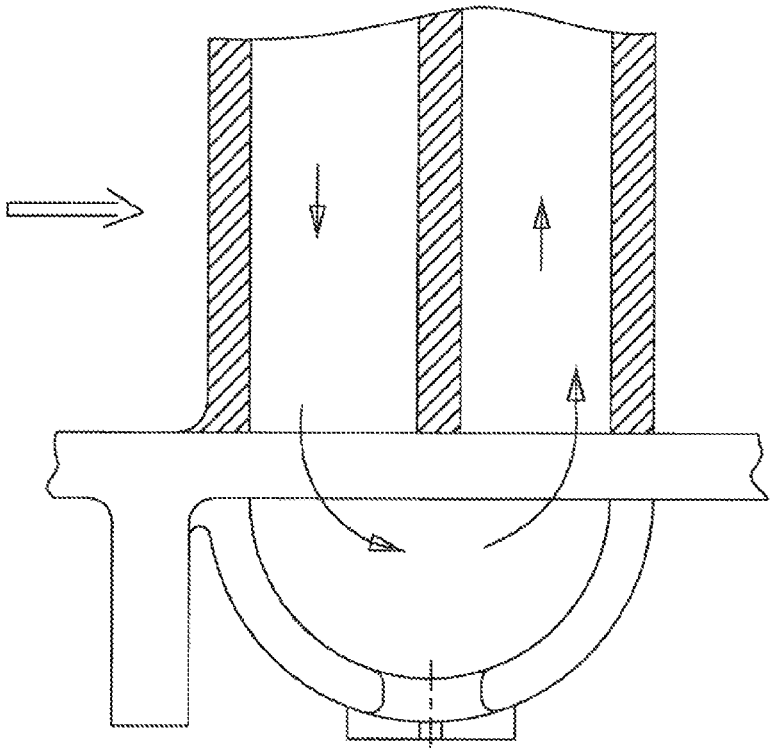
FIG 6 Prior Art
FIG. 6 shows a close-up view of a cross section for another prior art vane cooling circuit used to supply purge air to an inter-stage housing.
Figure 7:
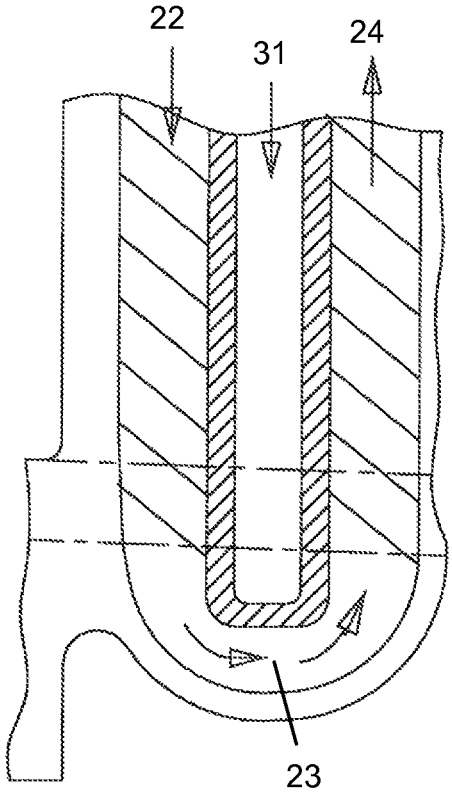
FIG. 7 shows a cross section view at the bottom of the first flow through channel between the first and second legs of the serpentine flow circuit in the vane of the present invention.

FIG. 7 shows another advantage of the vane cooling circuit of the present invention in which the lower turn 23 does not have any bleed off air used to purge the inter-stage housing as is done in the prior art FIGS. 5 and 6. Because of this, the cooling air from the first leg 22 smoothly flows into the second leg 24 without developing the turbulence that is the case in the prior art FIGS. 5 and 6 designs. The purge air flowing through the first purge channel 31 flows into the inter-stage housing area without being heated from the leading edge region like in the FIGS. 5 and 6 designs.

Cooling air for the three-pass serpentine flow circuit and the two separate purge air channels is supplied from the vane outer diameter shroud. The serpentine flow circuit includes trip strips in the channels to promote heat transfer from the hot metal to the cooler cooling air. The two purge channels 31 and 32 do not require trip strips in order to limit pressure loss for the purge air and the limit the heat transfer that passes from the hot metal into the purge cooling air. The purge air is then used in the inter-stage housing for cooling and purging of the rim cavities.

The cooling air flowing through the serpentine flow circuit passes along the leading edge to provide cooling to this hotter part of the airfoil, and then flows up and down through the second and third legs 24 and 26. The skewed trip strips enhance the heat transfer coefficient. A majority of the cooling air from the serpentine flow circuit is discharged through the trailing edge cooling holes 15 to provide cooling for the trailing edge section of the airfoil. A portion of the cooling air flowing through the third leg 26 is discharged into the aft rim cavity as purge air as seen by the arrow in FIG. 2 and in FIG. 4.

In the manufacture of the vane with the two purge channels 31 and 32, three separate core dies are used to form the ceramic cores. One core die is used for the airfoil serpentine flow circuit and two other core dies are used for the two purge channels 31 and 32. The purge channel ceramic core contains its own inlet and exit features. These ceramic cores can be pre-assembled onto the airfoil serpentine core prior to being inserted into the wax die.

Major design features and advantages of the vane cooling circuit with separate purge channels of the present invention are described below. The cooling air used as purge air for the rim cavity is not first used to cool the leading edge region of the airfoil, and therefore is cooler than in the prior art designs. This improves the turbine stage performance. Because the rim cavity purge air is channeled through a separate channel than the airfoil serpentine flow cooling air, no purge air is used for cooling of the airfoil that has the highest heat load. This minimizes any overheating of the cooling air used for purge of the inter-stage housing. A smooth surface is used for the purge channels with minimal heat transfer to the purge air because the purge channels are separate from the serpentine flow circuit. The separate and smooth purge channels also minimize any pressure loss due to turning within the airfoil. Using rim cavity purge air from separate cooling channels increase the design flexibility for the airfoil cooling circuit design as well as the inter-stage housing cooling system. The root discharge hole at the end of the third leg of the serpentine circuit can be used to provide additional support for the serpentine ceramic core during the casting process of the vane.

I claim the following:

1. A stator vane for an industrial gas turbine engine comprising:

an airfoil with a leading edge region and a trailing edge region;

the airfoil extending between an outer endwall and an inner endwall;

a first leg of a serpentine flow cooling circuit located along the leading edge region;

a second leg connected to the first leg through a lower turn channel;

a first purge channel located between the first leg and the second leg;

the first purge channel having an inlet opening above the outer endwall and an outlet opening below the inner endwall; and, the first purge channel being separate from the first and second legs of the serpentine flow cooling circuit; and, the outlet of the first purge channel is located above the lower turn of the serpentine flow cooling circuit.

2. The stator vane of claim 1, and further comprising:

the first purge channel has a smooth surface to minimize pressure loss and heat transfer.

3. The stator vane of claim 1, and further comprising:

the first and second legs include trip strips; and, the lower turn channel has a smooth surface to minimize pressure loss and heat transfer.

4. The stator vane of claim 1, and further comprising:

the lower turn channel includes an opening for a core print out; and, a cover plate to enclose the opening.

5. A stator vane for an industrial gas turbine engine comprising:

an airfoil with a leading edge region and a trailing edge region;

the airfoil extending between an outer endwall and an inner endwall;

a first leg of a serpentine flow cooling circuit located along the leading edge region;

a second leg connected to the first leg through a lower turn channel;

a first purge channel located between the first leg and the second leg;

the first purge channel having an inlet opening above the outer endwall and an outlet opening below the inner endwall; and, the first purge channel being separate from the first and second legs of the serpentine flow cooling circuit;

a third leg connected to the second leg through an upper turn channel;

a second purge channel located between the second and third legs;

the second purge channel having an inlet opening above the outer endwall and an outlet opening below the inner endwall; and, the second purge channel being separate from the three legs of the serpentine flow cooling circuit.

6. The stator vane of claim 5, and further comprising:

the second purge channel has a smooth surface to minimize pressure loss and heat transfer.

7. The stator vane of claim 5, and further comprising:

a row of trailing edge exit holes extending along the airfoil and connected to the third leg; and, a purge hole at an end of the third leg and opening below the inner endwall.

8. A stator vane for an industrial gas turbine engine comprising:

an airfoil with a leading edge region and a trailing edge region;

the airfoil extending between an outer endwall and an inner endwall;

a first leg of a serpentine flow cooling circuit located along the leading edge region;

a second leg connected to the first leg through a lower turn channel;

a first purge channel located between the first leg and the second leg;

the first purge channel extending between a pressure side wall and a suction side wall of the airfoil;

the first purge channel having an inlet opening above the outer endwall and an outlet opening below the inner endwall;

the first purge channel being separate from the first and second legs of the serpentine flow cooling circuit;

a third leg connected to the second leg through an upper turn channel;

a second purge channel located between the second and third legs;

the second purge channel extending between a pressure side wall and a suction side wall of the airfoil;

the second purge channel having an inlet opening above the outer endwall and an outlet opening below the inner endwall; and, the second purge channel being separate from the three legs of the serpentine flow cooling circuit.

9. The stator vane of claim 8, and further comprising:

the first purge channel has an outlet opening below an inner endwall.

10. The stator vane of claim 8, and further comprising:

the inlet opening of the second purge channel is located on a side of the vane above an outer endwall; and, the outlet opening of the second purge channel is located below an inner endwall.

* * * * *